United States Patent [19]

Grzina

[11] 4,264,273

[45] Apr. 28, 1981

[54] CASING AND CASING LINERS FOR CENTRIFUGAL PUMPS OF THE VOLUTE TYPE

[75] Inventor: Anthony Grzina, Artarmon, Australia

[73] Assignee: Warman International Limited, Artarmon, Australia

[21] Appl. No.: 63,769

[22] Filed: Aug. 6, 1979

Related U.S. Application Data

[63] Continuation of Ser. No. 893,716, Apr. 5, 1978, abandoned, which is a continuation of Ser. No. 694,796, Jun. 10, 1976, abandoned.

[30] Foreign Application Priority Data

Jun. 13, 1975 [AU] Australia ..... PC1992

[51] Int. Cl.[3] ..... F04D 7/04

[52] U.S. Cl. ..... 415/197; 415/219 A

[58] Field of Search ..... 415/196, 197, 203, 204, 415/206, 207, 219 A, 219 B, 219 C

[56] References Cited

U.S. PATENT DOCUMENTS

| | | | |
|---|---|---|---|
| 31,810 | 3/1861 | Locke | 415/204 UX |
| 440,798 | 11/1890 | Webbe | 415/196 |
| 619,736 | 2/1899 | Edwards | 415/204 X |
| 665,581 | 1/1901 | Roe et al. | 415/204 UX |
| 1,250,267 | 12/1917 | Bateman | 415/204 X |
| 1,355,982 | 10/1920 | La Bour | 415/204 |
| 1,380,798 | 6/1921 | Hansen et al. | 415/206 X |
| 2,190,670 | 2/1940 | Mann | 415/204 X |
| 3,090,319 | 5/1963 | Stanley | 415/197 |
| 3,155,045 | 11/1964 | Lown et al. | 415/197 |
| 3,160,106 | 12/1964 | Ashworth | 415/197 X |
| 3,265,002 | 8/1966 | Warman | 415/197 |
| 3,656,861 | 4/1972 | Zagar | 415/197 X |

FOREIGN PATENT DOCUMENTS

| | | | |
|---|---|---|---|
| 436064 | 6/1948 | Italy | 415/197 |
| 226402 | 12/1924 | United Kingdom | 415/219 C |

*Primary Examiner*—Leonard E. Smith
*Attorney, Agent, or Firm*—Haseltine and Lake

[57] ABSTRACT

A centrifugal pump casing of the volute type having a volute region comprising two circular segments of differing radii adjoining tangentially and a discharge branch leading tangentially away from the segment of greater radius. Liners for the casing are formed in the same manner. Preferably the adjoining circular segments are of common constant cross section.

4 Claims, 6 Drawing Figures

CASING AND CASING LINERS FOR CENTRIFUGAL PUMPS OF THE VOLUTE TYPE

This is a continuation of Ser. No. 893,716 filed Apr. 5, 1978, now abandoned which in turn is a continuation of Ser. No. 694,796 filed June 10, 1976 now abandoned.

FIELD OF THE INVENTION

The invention relates to casings for centrifugal pumps of the volute type and liners for such casings and has particular application for such pumps designed for pumping slurry.

BACKGROUND

In conventional slurry pumps of the volute type the section of the pump casing surrounding the periphery of the impeller is of changing cross section. The outer peripheral profile is made to approximate a volute shape having a radius of curvature increasing to a maximum at a point where it becomes tangential to the discharge branch.

Not only does the cross sectional area of this volute section of the casing vary but the cross sectional profile also varies around the periphery of the pump. The normal volute type casing therefore has a complex shape which results in a high cost of patterns and moulds for the manufacture of such parts.

Slurry pumps are often fitted with replaceable abrasion resistant liners. The difficulty of manufacturing casings and liners to a true volute shape is further complicated by the necessity for closely matching the outside shape of the liner and the inside shape of the casing. This matter is further complicated by the nature of the abrasion resistant materials which must be used for construction of the liners.

For example, liners for slurry pumps are often constructed in hard cast alloy irons. These materials cannot be easily machined by normal methods and are therefore used in the "as cast" condition with a minimum of machining. Obtaining the required fit between liners and casing is made difficult because of the complex shape of conventional casings.

Another material often used for slurry pump liners is moulded rubber.

When a pump is required to be fitted with rubber liners the construction is complicated in two ways. Firstly, it is important that the rubber liners fit closely into the casing; the requirement for accurate interior shape for the casing and corresponding exterior shape of the liner is more important than for cast metal liners.

Secondly, since the rubber moulds must be constructed from steel or similar material to produce a smooth accurate finish, manufacturing costs are affected greatly by the complexity of the casing shape.

Pump casings are known wherein the casing is of substantially circular shape, or a combination of part of a single circle and part of a conventional volute shape. However, they suffer the disadvantages of poor hydraulic performance due to too great a departure from the ideal volute, and in addition they are still difficult to manufacture.

SUMMARY OF THE INVENTION

It is, therefore, an object of this invention to provide a casing and corresponding liner for a volute type pump having a configuration which is sufficiently close to a true volute that it does not adversely affect the hydraulic performance of the pump to any marked degree and yet is of a form which is simple to manufacture and facilitates accurate fit up of liners.

This object is achieved according to this invention by providing a casing or a casing liner the volute region of which comprises two circular segments of differing radii adjoining tangentially and a discharge branch leaving tangentially away from the segment of greater radius.

One big advantage of the present invention is that it allows patterns and rubber moulds to be largely formed by simple circular machining either in a lathe or boring mill. By using a constant axial cross-section around the inner periphery of the casing it is possible to turn completely circular patterns for each of the two radii and cut and join segments of them as reqired to form left and right hand patterns, core boxes and moulds for front and back halves of the pump casings and liners respectively.

The invention will now be described by way of example in relation to the accompanying drawings showing the prior art as well as embodiments of the invention.

DETAILED DESCRIPTION

Figure 1:
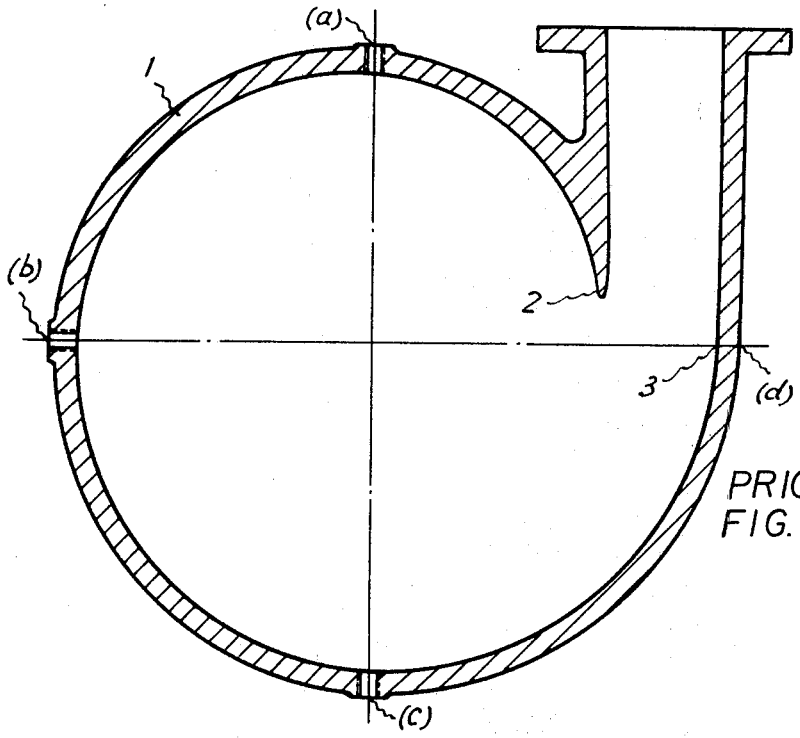
PRIOR ART FIG. 1.
FIG. 1 is a cross section of a conventional volute type of casing for a centrifugal pump, said cross section being in a plane normal to the axis of impeller rotation.
Figure 2A:
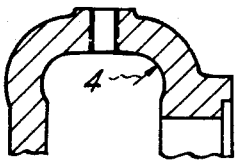
PRIOR ART FIG. 2a.
FIG. 2 shows sections through the casing shown in FIG. 1, said sections being in planes passing through the axis of impeller rotation.
Figure 2B:
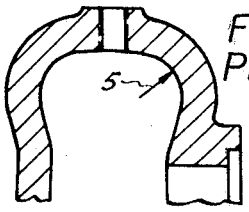
FIG. 2b PRIOR ART
Figure 2C:
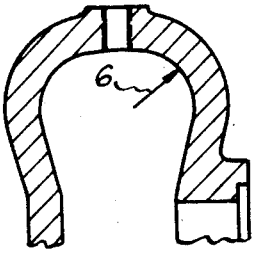
FIG. 2c PRIOR ART
Figure 2D:
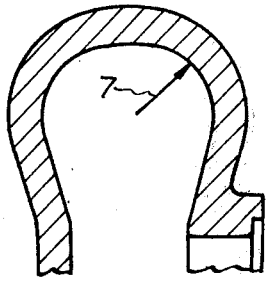
FIG. 2d PRIOR ART

Referring to FIG. 1 the typical volute shape casing 1 of conventional volute type pumps has a gradually increasing radius of curvature from the edge or cutwater 2 of the discharge branch to the point 3 where the discharge branch becomes tangential to the volute.

In FIGS. *2a–2d* axial cross sections at various points of the casing in FIG. 1 are shown. It can be seen that the inner radius of the cross sections varies also as indicated by the radii 4, 5, 6 and 7 in FIGS. *2a–2d*. The complexity of the solid shape is obvious and the manufacture of patterns and moulds require costly forming by hand tools or very sophisticated machine operations.

Figure 3:
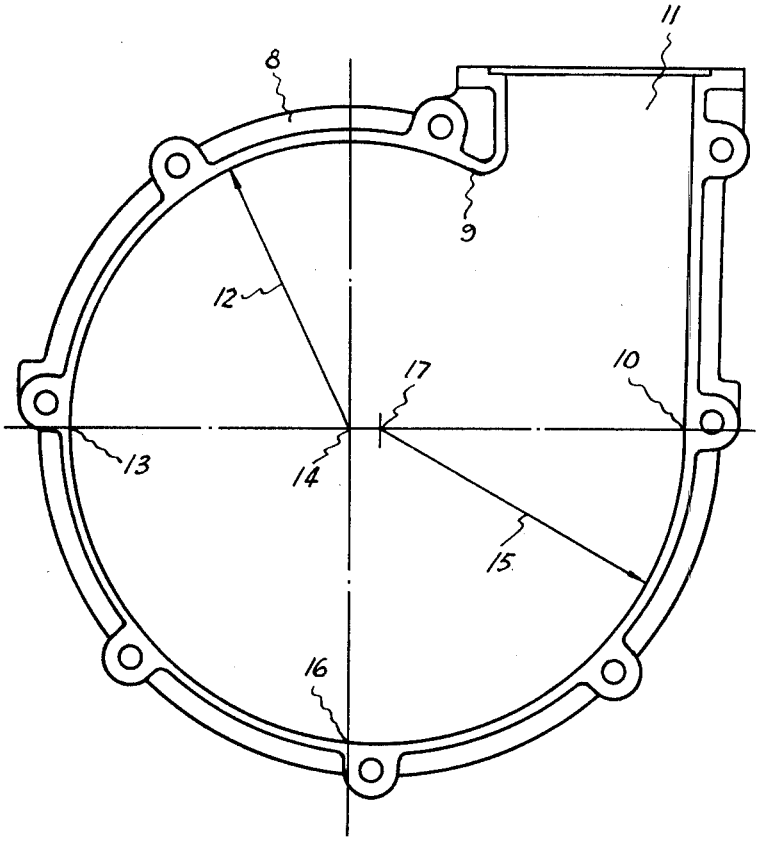
FIG. 3 is a inside view of a casing half of a centrifugal pump according to this invention, the pump casing being split in a plane normal to the axis of impeller rotation.

FIG. 3 shows a pump casing half 8 according to this invention. The peripheral profile of this casing between the discharge branch edge or cutwater 9 and the tangential contact point 10 of the discharge branch 11 is formed of two radii only. One radius of curvature 12 forms the casing part from cutwater 9 to a point 13 with its center 14, and a second radius 15 applies to the casing part from point 13 through point 16 to point 10 having its center at 17. The radii are chosen so that the combined shape formed by the two arcs from the cutwater 9 through common tangent point 13 and points 16 and 10 approximates the required volute.

Figure 4:
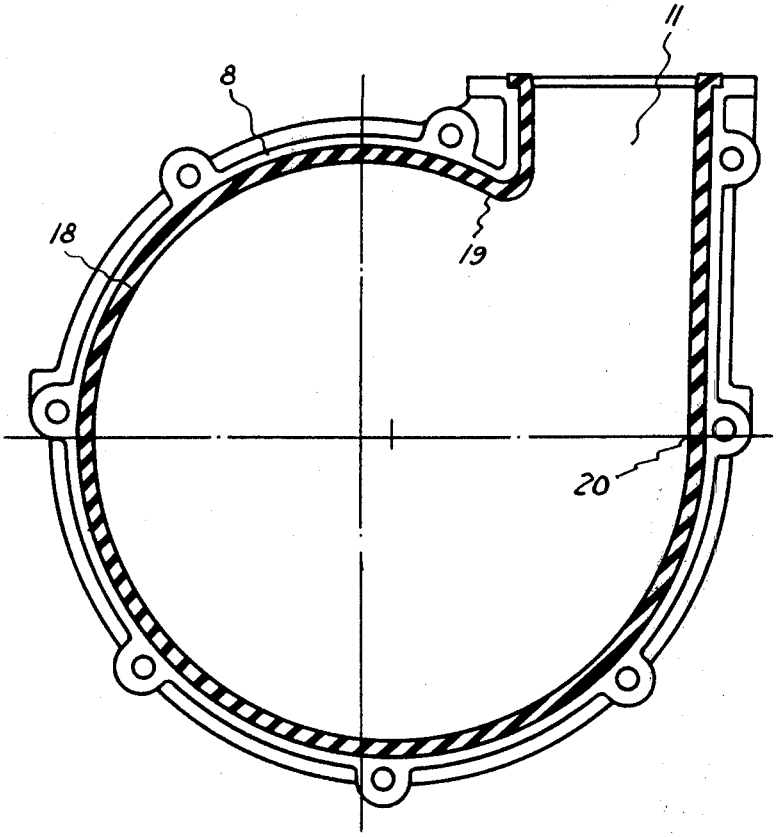
FIG. 4 shows the casing half of FIG. 3 with a rubber liner placed therein.

FIG. 4 shows the same casing 8 as in FIG. 3 fitted with a rubber liner 18. The inner and outer peripheral shapes of both liner and casing are all formed by two radii only between a point 19 at the cutwater and the tangential contact point 20 of the discharge branch 11.

Figure 5:
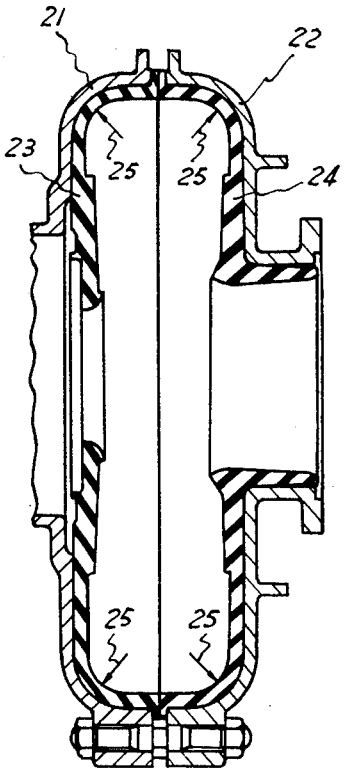
FIG. 5 is a cross section of a casing and rubber liners according to this invention for a centrifugal slurry pump, said cross section being in a plane through the axis of impeller rotation.

FIG. 5 is a cross section through the axis of impeller rotation of a casing comprised of two halves 21 and 22 fitted with split rubber liners 23 and 24. According to the invention the inner radius 25 of the casing and liner halves is the same for all cross sections around the periphery, for example at points 19 and 20 in FIG. 4.

Figure 6:
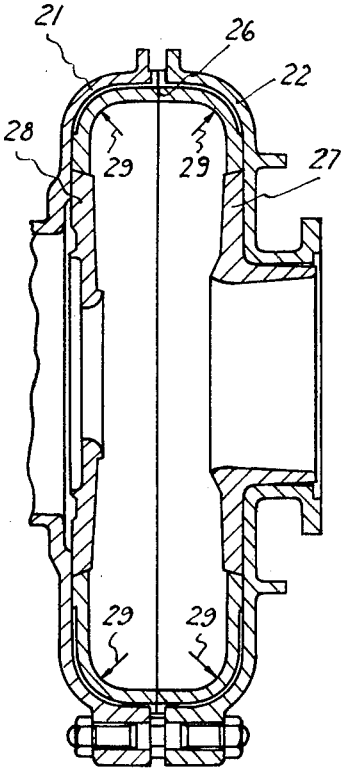
FIG. 6 shows the same cross section of a casing as FIG. 5 but incorporating metal liners.

FIG. 6 shows the same pump casing halves 21 and 22 as in FIG. 5 fitted in this case with cast metal liners composed of a "volute" liner 26, a throat bush liner 27 and a frame plate insert 28. The inner radii 29 of the "volute" liner 26 are constant around the perphery of the pump casing and match the casing profile from the cutwater area (9 in FIG. 3) to the tangential joint of the discharge branch (10 in FIG. 3).

It is obvious that the simplified shape of casing and liners according to this invention greatly reduces the cost and time required for manufacture of patterns for the manufacture of casings and hard iron liners and for the manufacture of moulds for production of rubber (or other elastomer) liners.

I claim:

1. A centrifugal pump apparatus casing wherein: said casing is provided with an interior defined by two discrete radii of curvature, one said radii being larger than the other; each of said radii defines substantially one half of said casing interior; and discharge branch means leading tangentially away from said casing interior defined by the larger of said two discrete radii.

2. Centrifugal pump apparatus casing as claimed in claim 1, wherein: said casing interior comprises a removable lining having an internal surface defined by said two discrete radii of curvature.

3. A centrifugal pump casing as claimed in claim 1, wherein: said casing comprises two halves.

4. A centrifugal pump casing as claimed in claim 1, wherein: said casing being formed of a unitary member.

* * * * *